US005940915A

United States Patent [19]

Nam

[11] Patent Number: 5,940,915

[45] Date of Patent: Aug. 24, 1999

[54] ERROR CHECKING DEVICE FOR WASHING MACHINE AND CHECKING METHOD THEREOF

[75] Inventor: Tae-Yeal Nam, Incheon, Rep. of Korea

[73] Assignee: Daewoo Electronics Co., Ltd., Seoul, Rep. of Korea

[21] Appl. No.: 09/096,461

[22] Filed: Jun. 11, 1998

[30] Foreign Application Priority Data

Jun. 11, 1997 [KR] Rep. of Korea ..... 97-23992

[51] Int. Cl.[6] ..... D06F 33/02

[52] U.S. Cl. ..... 8/159; 68/12.01; 68/12.27

[58] Field of Search ..... 8/159; 68/12.01, 68/12.02, 12.12, 12.27

[56] References Cited

U.S. PATENT DOCUMENTS 4,275,464 6/1981 Schmidt ..... 68/12.01 X
4,455,653 6/1984 Le Gars et al. ..... 68/12.01 X
4,763,493 8/1988 Nishite et al. ..... 68/12.27
4,977,394 12/1990 Manson et al. ..... 68/12.01 X

*Primary Examiner*—Philip R. Coe
*Attorney, Agent, or Firm*—Jacobson, Price, Holman & Stern, PLLC

[57] ABSTRACT

In a washing machine, during a washing mode, a number of times the washing machine is operated is counted and stored in a memory. Respective numbers of times that error signals are generated at the respective washing steps are counted and stored in the memory. When a checking mode button is pushed, a used mode is converted into the checking mode and simultaneously the number of times the washing machine is operated stored in the memory is displayed. By further pushing of a checking mode button, the respective numbers of times that error signals occurred as stored in the memory are respectively displayed. By pushing a clear button, data stored in the memory are cleared. Thus, during a washing operation, numbers of times that errors occurred at each of the washing steps are separately stored into the memory. During a checking operation, the numbers of times of errors at each of washing steps which are stored in the memory can be displayed on the display part.

9 Claims, 2 Drawing Sheets

ERROR CHECKING DEVICE FOR WASHING MACHINE AND CHECKING METHOD THEREOF

BACKGROUND OF THE INVENTION

1. Field of the Invention

The present invention relates to an error checking device for a washing machine and a checking method thereof, and more particularly to an error checking device for a washing machine and a checking method thereof capable of storing and displaying a number of times of errors at each washing step to simplify checking and servicing.

2. Prior Art

Recently, washing machines are being provided with various functions. For example, process cycles can be set arbitrarily by a user, or abnormalities can be detected during a drainage or dehydration process in some washing machines. It is proposed to use the above-mentioned conventional display apparatus in the washing machine. For example, a process cycle set by the user may be displayed on the conventional display apparatus. In order to cause the panel plate corresponding to the cycle set by the user to appear at the front disposition, since the panel plate is arranged according to the time sequence, other panel plates sometimes must be rotated rapidly by the rotating shaft. Therefore, it sometimes takes a long time for the proper display to appear.

In addition, abnormalities detected during the drainage or dehydration process may be displayed by the conventional display apparatus. As a reference, a washing machine which displays the progress of the washing operation and abnormalities is shown in U.S. Pat. No. 4,763,493, issued Aug. 16, 1988 to Nishite et al.

According to the conventional washing machine, however, when the washing machine malfunctions, a service man must fully operate the washing machine to find which part of the washing machine has trouble.

Since a user does not have minimal knowledge of error history or use history of the washing machine when the washing machine malfunctions, it requires too much time, cost, and human efforts to find the correct malfunction cause.

SUMMARY OF THE INVENTION

The present invention has been made to overcome the above-described problems of the prior art, and accordingly it is an object of the present invention to provide an error checking device for a washing machine capable of storing and displaying a number of times of errors at each washing step to simplify checking and servicing.

It is another object of the present invention to provide a checking method by an error checking device for a washing machine capable of storing and displaying a number of times of errors at each washing step to simplify checking and servicing.

To achieve the above object, the present invention provides an error checking device for a washing machine comprising:

a use signal generating part for generating a use signal of the washing machine to determine a number of times that the washing machine is operated;

an error signal generating part for generating respective error signals when errors are generated at respective washing steps to determine respective numbers of times that errors are generated at respective washing steps;

a memory for storing data having the number of times washing machine is operated and the respective numbers of times that errors are generated at the respective washing steps;

a command inputting part for inputting a conversion command for converting the use mode of the washing machine into a checking mode, a display command for displaying data to be checked, and a clear command for clearing the data;

a display part for displaying the data stored in the memory depending on the display command inputted by means of the command inputting part; and a microprocessor having a function to count a number of times the washing machine is operated and to store the counted number, a function to separately count respective numbers of times that errors are generated at respective washing steps and to store the counted numbers, a function to display the data stored in the memory at the checking mode depending on the display command inputted by means of the command inputting part, and a function to clear the data stored in the memory at the checking mode depending on the clear command.

Also, to achieve the above other object, the present invention provides a checking method by an error checking device for a washing machine, the method comprising the steps of:

checking whether a selected mode is a washing mode or checking mode after the washing machine is switched on;

if the selected mode is the washing mode, then inputting a use signal generated from a signal generating part into a microprocessor, counting by the microprocessor a number of times the washing machine is operated and storing the counted number into a memory, separately inputting respective error signals generated by an error signal generating part into the microprocessor when errors are generated at respective washing steps, counting by the microprocessor respective numbers of times of error signals generated at the respective washing steps and storing the counted numbers into the memory;

if the selected mode is the checking mode, then displaying the corresponding data stored in the memory on a display part when a display command for displaying data having the number of times the washing machine is operated and the respective numbers of times that errors are generated at the respective washing steps are inputted into the microprocessor; and in the checking mode, clearing the corresponding data stored in the memory when a clear command for clearing data having the number of times the washing machine is operated and the respective numbers of times that errors are generated at the respective washing steps are inputted into the microprocessor.

According to the error checking device for a washing machine of the present invention constructed as described above, when the washing operation is carried out at the washing mode, numbers of times that errors occur at each of the washing steps are stored into the memory, and when the checking operation is carried out at the checking mode, the numbers of times of errors at each of the washing steps which are stored in the memory are displayed on the display part. Therefore, parts where the washing machine frequently generates errors can be checked and serviced easily. Thereby, malfunction of the washing machine is prevented before it happens. Also, even though the washing machine has a mechanical trouble, the service man can initially check and service the parts where errors are frequently generated, thereby checking and servicing the mechanical troubles of the washing machine is easy.

BRIEF DESCRIPTION OF THE DRAWINGS

The above objects and other advantages of the present invention will become more apparent by describing in detail preferred embodiments thereof with reference to the attached drawings in which.

DESCRIPTION OF THE PREFERRED EMBODIMENTS

Hereinafter, the present invention will be described in detail with reference to the accompanying drawings.

Figure 1:
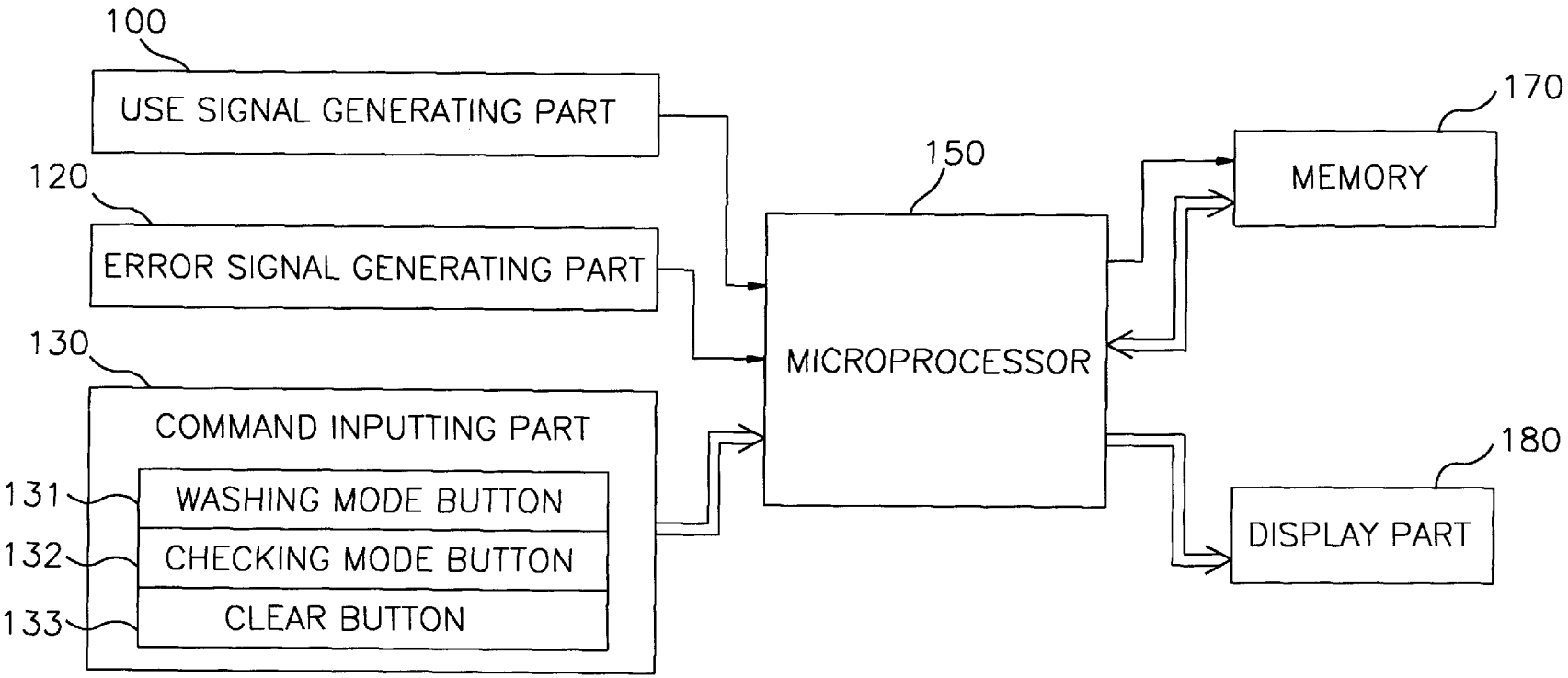
FIG. 1 is a schematic block diagram for showing an error checking device of a washing machine according to the present invention in which a description of constituent parts is described in the blocks.
Figure 2:
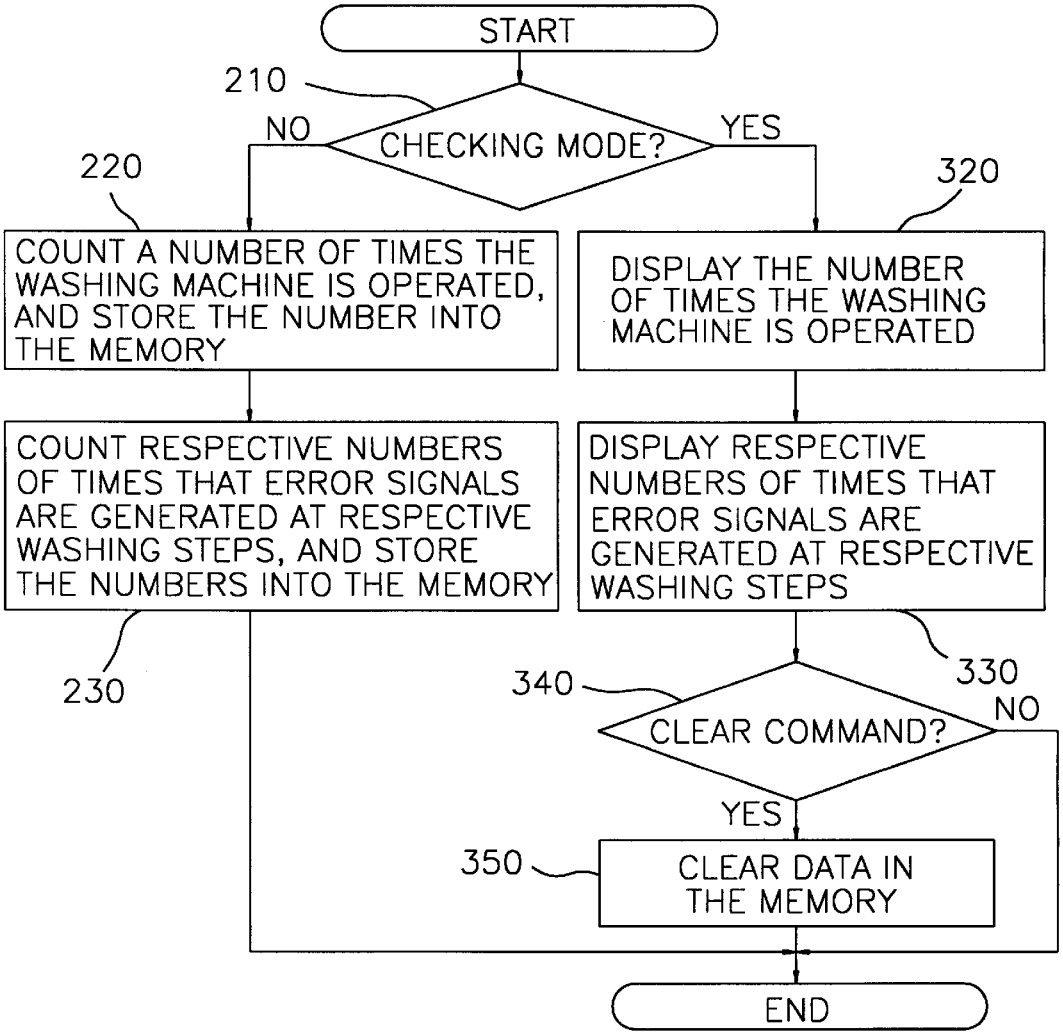
FIG. 2 is a flow chart for showing a checking method by the error checking device of the washing machine of FIG. 1.

FIG. 1 is a schematic block diagram for showing an error checking device of a washing machine according to the present invention in which a description of constituent parts is described in the blocks. FIG. 2 is a flow chart for showing a checking method by the error checking device of the washing machine of FIG. 1.

As shown in FIG. 1, a use signal generating part 100 generates a use signal of the washing machine to determine the number of times that the washing machine is operated. For example, in this embodiment, a user pushes either the washing mode button 131 or the checking mode button 132 after the washing machine is switched on, so that the used mode of the washing machine can be determined. The use signal of the washing machine is so determined as to be generated when the washing mode button 131 is pushed.

An error signal generating part 120 generates respective error signals when errors are generated at respective washing steps to determine the respective numbers of times that errors are generated at respective washing steps, for example, a water supply, a water level, wash, rinse, drainage, and dehydration.

A memory 170 stores data. The data comprises the number of times the washing machine is operated and the respective numbers of times that errors are generated at the respective washing steps.

A command inputting part 130 inputs commands. The commands comprise a conversion command for converting the use mode of the washing machine into a checking mode, a display command for displaying data to be checked, and a clear command for clearing the data.

For example, the embodiment of this washing machine is determined such that the used mode of the washing machine is converted to the checking mode from the washing mode when a user once pushes the checking mode button 132. The embodiment of this washing machine also is determined such that the data comprising the number of times the washing machine is operated and the respective numbers of times that errors are generated at the respective washing steps are displayed on a display part 180 according to the order when the user repeatedly pushes the checking mode button 132. Furthermore, the embodiment of this washing machine is determined such that the data stored in the memory 170 is cleared when the user pushes the clear button 133.

A display part 180 displays the data stored in the memory 170 depending on the display command inputted by means of the command inputting part 130.

A microprocessor 150 has a function to count a number of times the washing machine is operated depending on a use signal generated from a signal generating part 100 and to store the counted number in the memory 170. For example, if the user pushes the washing mode button 131, then the microprocessor 150 receives the use signal of the washing machine, counts the number of times the washing machine has been operated, and stores the number in the memory 170.

In the washing mode, the microprocessor 150 has a function to separately count respective numbers of times that errors are generated depending on the error signals generated when errors are generated at respective washing steps at respective washing steps, for example, a water supply, a water level, wash, rinse, drainage, and dehydration, and stores the numbers in the memory 170.

In the checking mode, the microprocessor 150 has a function to display the data stored in the memory 170 on the display part 180 depending on the display command inputted by the user. For example, the microprocessor 150 of this embodiment has a function to convert the used mode of the washing machine into the washing mode from the checking mode and simultaneously to display on the display part 180 the number of times the washing machine is operated as stored in the memory 170 when a user once pushes the checking mode button 132. The microprocessor 150 of this embodiment also has a function to display on a display part 180 according to the order the respective numbers of times that errors are generated at the respective washing steps, for example, a water supply, a water level, wash, rinse, drainage, and dehydration, when the user repeatedly pushes the checking mode button 132.

Furthermore, the microprocessor 150 of this embodiment has a function to clear the data stored in the memory 170 depending on the clear command, for example, when the user pushes the clear button 133.

Hereinbelow, a checking method of the error checking device of the washing machine according to the present invention constructed as above will be described with reference to FIG. 2.

1) The user pushes a washing mode button 131 or a checking mode button 132 after the washing machine is switched on. The microprocessor checks whether the selected mode is the washing mode or the checking mode (step 210).

2) If the washing mode is selected ("NO" is selected in step 210), then a use signal is generated from a signal generating part 100. The microprocessor 150 receives this signal, counts the number of times the washing machine is operated, and stores the counted number in the memory 170 (step 220).

Ex)UW:k←k+1 k is a number of times the washing machine is operated.

3) In the washing mode, the microprocessor 150 separately receives respective error signals generated by an error signal generating part 120 into the microprocessor 150 when errors are generated at respective washing steps, counts respective numbers of times of error signals generated at the respective washing steps, and stores the counted numbers in the memory 170 (step 230).

Ex)IE:A←A+1

OE:B←B+1

UE:C←C+1

LE:D←D+1

A is a number of times of I.E.(inlet errors).

B is a number of times of O.E.(outlet errors).

C is a number of times of U.E.(unbalance errors).

D is a number of times of L.E.(lid errors).

4) If the checking mode is selected ("YES" is selected in step 210), then the used mode of the washing machine is converted to the checking mode from the washing mode and simultaneously the number of times the washing machine is operated as stored in the memory 170 is displayed on the display part 180 (step 320).

5) When the checking mode button 132 is repeatedly pushed, the respective numbers of times that errors are generated at the respective washing steps and the corresponding names of errors are displayed on a display part 180 according to the order (step 330).

6) If the checking mode button 132 is pushed (step 340), then the microprocessor 150 receives the clear command and clears the data stored in the memory 170 (step 350).

7) When the above-mentioned error checking operation is completed, the checking method ends.

According to the error checking device for a washing machine of the present invention constructed as described above, when the washing operation is carried out at the washing mode, numbers of times that errors occur at each of the washing steps are stored in the memory, and when the checking operation is carried out at the checking mode, the numbers of times that errors occur at each of washing steps which are stored in the memory are displayed on the display part. Therefore, parts where the washing machine frequently generates errors can be checked and serviced with ease. Thereby, malfunctioning of the washing machine is prevented before it happens. Also, even though the washing machine has mechanical trouble, the service man can initially check and service the parts at which frequent errors are generated, thereby checking and servicing the mechanical troubles of the washing machine is easy.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. An error checking device for a washing machine comprising:

a use signal generating part for generating a use signal of the washing machine to determine a number of times that the washing machine is operated;

an error signal generating part for generating respective error signals when errors are generated at respective washing steps to determine respective numbers of times that errors are generated at respective washing steps;

a memory for storing data having the number of times the washing machine is operated and the respective numbers of times that errors are generated at the respective washing steps;

a command inputting part for inputting a conversion command for converting the use mode of the washing machine into a checking mode, a display command for displaying data to be checked, and a clear command for clearing the data;

a display part for displaying the data stored in the memory depending on the display command inputted by means of the command inputting part; and a microprocessor having a function to count a number of times the washing machine is operated and to store the counted number, a function to separately count respective numbers of times that errors are generated at respective washing steps and to store the counted numbers, a function to display the data stored in the memory at the checking mode depending on the display command inputted by means of the command inputting part, and a function to clear the data stored in the memory at the checking mode depending on the clear command.

2. An error checking device for a washing machine as claimed in claim 1, wherein the command inputting part has a checking mode button, and pushing once the checking mode button serves as a command for converting a mode of the washing machine into the checking mode.

3. An error checking device for a washing machine as claimed in claim 2, wherein further repeated pushings of the checking mode button serve as commands for displaying on the display part the respective numbers of times that errors are generated at the respective washing steps which are stored in the memory.

4. An error checking device for a washing machine as claimed in claim 1, wherein the command inputting part has a checking mode button, and pushing once the checking mode button serves as a command for converting the used mode of the washing machine into the washing mode from the checking mode and simultaneously for displaying on the display part the number of times the washing machine is operated which is stored in the memory.

5. An error checking device for a washing machine as claimed in claim 1, wherein the command inputting part has a clear button, and pushing of the clear button serves as a command for clearing the number of times the washing machine is operated and the respective numbers of times that errors are generated at the respective washing steps which are stored in the memory.

6. A checking method of an error checking device for a washing machine, the method comprising the steps of:

checking whether a selected mode is a washing mode or checking mode after the washing machine is switched on;

if the selected mode is the washing mode, then inputting a use signal generated from a signal generating part into a microprocessor, counting by the microprocessor a number of times the washing machine is operated and storing the counted number into a memory, separately inputting respective error signals generated by an error signal generating part into the microprocessor when errors are generated at respective washing steps, counting by the microprocessor respective numbers of times of error signals generated at the respective washing steps and storing the counted numbers into the memory;

if the selected mode is the checking mode, then displaying the corresponding data stored in the memory on a display part when a display command for displaying data having the number of times the washing machine is operated and the respective numbers of times that errors are generated at the respective washing steps are inputted into the microprocessor; and in the checking mode, clearing the corresponding data stored in the memory when a clear command for clearing data having the number of times the washing machine is operated and the respective numbers of times that errors are generated at the respective washing steps are inputted into the microprocessor.

7. A checking method of an error checking device for a washing machine as claimed in claim 6, once pushing of the checking mode button serves as a command for converting the used state of the washing machine into the washing mode from the checking mode and simultaneously for displaying on the display part the number of times the washing machine is operated which is stored in the memory.

8. A checking method of an error checking device for a washing machine as claimed in claim 6, wherein further repeated pushings of the checking mode button serve as commands for displaying on the display part the respective numbers of times that errors are generated at the respective washing steps which are stored in the memory.

9. A checking method of an error checking device for a washing machine as claimed in claim 6, wherein pushing of the clear button serves as a command for clearing the number of times the washing machine is operated and the respective numbers of times that errors are generated at the respective washing steps which are stored in the memory.

* * * * *